United States Patent [19]

Fabian et al.

[11] 4,448,660

[45] May 15, 1984

[54] MONITORING APPARATUS

[75] Inventor: Peter Fabian, Freigericht, Fed. Rep. of Germany

[73] Assignee: Heraeus Elektroden GmbH, Hanau, Fed. Rep. of Germany

[21] Appl. No.: 389,285

[22] Filed: Jun. 17, 1982

[30] Foreign Application Priority Data

Jun. 19, 1981 [DE] Fed. Rep. of Germany ..... 3124108

[51] Int. Cl.³ ..... C25C 7/00

[52] U.S. Cl. ..... 204/225; 204/219; 204/220; 204/228; 204/250

[58] Field of Search ..... 204/228, 225, 219–220, 204/250

[56] References Cited

U.S. PATENT DOCUMENTS

| | | | |
|---|---|---|---|
| 3,654,118 | 4/1972 | Selwa | 204/225 |
| 4,004,989 | 1/1977 | Ralston | 204/225 |
| 4,098,639 | 4/1978 | Ralston et al. | 204/225 |
| 4,098,666 | 7/1978 | Ralston | 204/228 |

*Primary Examiner*—R. L. Andrews

*Attorney, Agent, or Firm*—Muserlian, Bierman, Bierman & Peroff

[57] ABSTRACT

A monitoring and control apparatus for flowing mercury electrolytic cells by measurement of the voltage drop in the shunted feed line of each electrode group comprising taps at the ends of a measured section of electrical bus bars for each electrode group electrically connected to a measuring means whereby the measured voltage drop is fed as an amplified signal to the measuring means, a control means set for a value from the total cell current divided by the number of taps comparing the actual measured values at various feed lines and a signal means activated when a set excess current is exceeded and to actuate the adjusters for a group of electrodes to lift the electrodes stepwise by an adjustable amount until excess current is not measured by comparison indicating that the feed line is no longer overloaded and a method of monitoring electric current in a mercury cell.

4 Claims, 1 Drawing Figure

MONITORING APPARATUS

STATE OF THE ART

Figure 1:
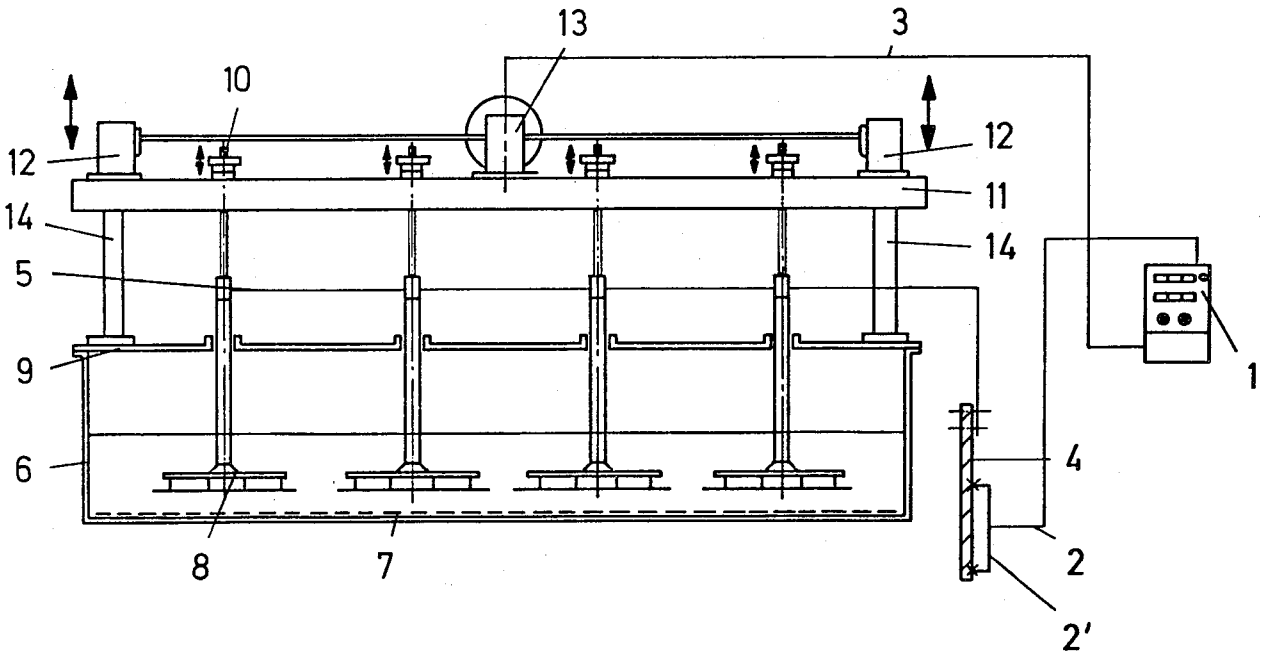

The operation of mercury cells for chlor-alkali production has become expensive due to labor costs and increases in energy prices and by enviromental requirements and it is desired to optimize the operations thereof as much as possible. Eventually, mercury cells will probably be replaced with new types of cells such as membrane cells so any investment expenses for optimizing existing cells should be kept at a minimum. The use of dimensionally stable anodes in mercury cells makes the use of monitoring devices necessary to prevent short-circuiting and destruction of the anodes.

OBJECTS OF THE INVENTION

It is a object of the invention to provide a relatively inexpensive monitoring and control apparatus for mercury cells operating with a very low cell voltage and a high current yield.

It is another object of the invention to provide a method of monitoring the voltage of electrode groups in a mercury cell to avoid short-circuit damage to the metal anodes and with a minimum expenditure of energy.

These and other objects and advantages of the invention will become obvious from the following detailed description.

THE INVENTION

The monitoring and control apparatus of the invention for flowing mercury electrolytic cells by measurement of the voltage drop in the shunted feed line of each electrode group is comprised of taps at the ends of a measured section of electrical bus bars for each electrode group electrically connected to a measuring means whereby the measured voltage drop is fed as an amplified signal to the measuring means, a control means set for a value from the total cell current divided by the number of taps comparing the actual measured values at various feed lines and a signal means activated when a set excess current is exceeded and to actuate the adjusters for a group of electrodes to lift the electrodes stepwise by an adjustable amount until excess current is not measured by comparison indicating that the feed line is no longer overloaded. The apparatus of the invention avoids the expense of a fully automatic and central control system performed by a central computer.

The apparatus is preferably housed in an insulated material housing with the electronic system arranged in the top portion of the housing and it serves to control a single mercury cell. Two digital displays for the total cell voltage and the individual currents in the bus bars may be arranged beneath the housing and the output contactors for the anode lifting actuators may be arranged in the bottom of the housing.

Additionally, room for lines connecting the measuring means to the control means and the outer built-in plug-type connectors is provided and the housing is preferably provided with a see-through cover. All connections are preferably effected with multiple plug connectors so that individual elements or the entire device can be easily replaced. The signal and operating elements are preferably arranged in the bottom portion of the cover.

Because of the corrosive enviroment, the use of metal parts on the surface of the housing or the plugs is avoided as far as it is possible In the electrical input circuit, input insert cards are arranged in insert card places with the number being determined by the number of bus bars and each insert card has two input channels which are separated in their potential from both the power supply means and from the outputs. A highly reliable input amplifier with low drift values amplifies the input signal of about 5 to 6 mv originating from the bus bars to about 1000 times and this voltage is converted by analog-digital conversion into a proportional frequency which is fed by an optocoupler to a digital-analog converter.

The total transmission is 1 to 1 and this measure ensures the necessary potential separation between the input circuits and the processing circuit. Each input insert card has two current supplies whereby each input channel is supplied independently and is electrically separated from each other which is a necessary precaution since all measuring points can have a voltage difference of not more than 4 to 5 volts within a cell.

The use of an optocoupler as a transmission element avoids the magnetic influence of external fields which occur in electrolytic systems and the alternate current voltage coupling has the advantage that the optocoupler is simple to monitor. Even if the optocoupler switches through constantly or interrupts, this defect is immediately indicated on the insert card by zero voltage monitoring. Also, each input insert card has a defect indicator for each channel.

In the mean evaluation circuit and delay circuit, all outputs are added up in another insert card and are averaged so that the output signal corresponds to the arithmetic mean value of the input signals. This mean value amplifier can be set by a switch on the insert card to the number of outputs and the respective input signals are compared in another part of the insert card with the bus bars with mean value corresponding to the number of electrode group-adjusting units above the electrolysis cell with the results being fed to an evaluation circuit.

The evaluation circuit compares the individual values with the mean value and when an adjustable percent tolerance limit above the mean value is exceeded, the apparatus drives the motors of the anode adjusting unit for the said electrode group whereby the electrodes are raised by an adjustable distance. The process is repeated automatically if the excess current has not been eliminated after the adjustable movement of the electrode group until the current consumption of the bus bar is within the tolerable limit.

Preferably, the process also activates an optical alarm signal and an acoustical alarm signal and the monitoring circuit is not activated until the optical signal has been manually shut off.

For voltage determination and contactor control, a suitable connection of the mercury cathodes of the cell is also conducted over an isolating amplifier and is displayed on a digital instrument so that the operating voltage of the cell can be determined in the device at any time. The voltage supply for the contactor control which is secured by special locking circuits with the operating loads even when electronic switching elements such as transistors, etc. fail is combined with the isolating amplifier of the line operating voltage on a common insert card. Preferably, the contactors are encased in steel plate housings to shield them from the influence of static magnetic fields.

In the operation of the mercury cell with the monitoring and control apparatus of the invention, the cell is started up in the usual manner and the cell voltage and the average nominal current consumption of the various bus bars is immediately read from the digital displays. Before the cell is adjusted to the desired operating voltage, the actual current consumption of the individual bus bars are now scanned on the device and in case of deviations above a certain level, the inclination of the electrode frames are changed manually by driving the actuators on the anode supporting frames so that the current distribution is corrected over the length of the frame. If this measure is not sufficient, the current consumptions of the individual bus bars can be checked by tong-test instruments and be individually adjusted.

After these steps, the anode frames are lowered in adjustable steps by scanners on the device and the cell thus is adjusted to the operating temperature. The apparatus automatically blocks in the adjusted interval periods and prevents too rapid lowering of the anodes. At the same time, the apparatus monitors the current consumption of the individual bus bars and blocks when the set maximum percentage deviation from the arthmetic means of the total current consumption has been attained whereby the anodes are not in any danger of being short-circuited.

This ensures that the current consumption of the individual bus bars shows no deviation beyond the set tolerance of the current consumption in a cell adjusted in this manner to the desired voltage. In case excess current above the set tolerances appears in one or several bus bars by changes in the anode suspensions or in the cathode geometry, the device drives the actuator(s) of the entire anode group and raises it step-by-step parallel to the cathode by a previously set amount. When the excess current has been eliminated by this automatic measure, the device indicates, until it is manually cleared, which bus bar was in the excess current range so that the operator knows immediately where a correction has to be made. After eliminating the error source causing the excess current, the cell can be adjusted again to the desired voltage by means of scanning as described above.

The novel method of the invention for correcting short circuits in a flowing mercury electrolysis cell comprising measuring voltage drops over measured sections of bus bars for each electrode group, amplifing the measured voltage and feeding the said voltage to a measuring means, comparing the measured voltage from the measured sections, and when the measured voltage exceeds a predetermined value, actuating a stepwise lifting of the electrode group until the excess voltage is reduced.

REFERRING NOW TO THE DRAWING

The FIGURE schematically illustrates a cross-sectional view of a mercury cell with the apparatus of the invention.

The cell of the FIGURE is comprised of a cell trough 6 and a cell cover 9 on which is secured supports 14 which carry a frame 11 used to adjust the electrode gap between anodes 8 and the mercury cathode 7. Monitoring and control device 1 is connected by test wire 2 to bus bar 4 over a shunt-tap or measured section 2'. Bus bar 4 is electrically and flexibly connected to individual anodes 8 by a current feed stem 5 and the anodes 8 are provided with known feed bosses arranged in a sleeve for example, which in turn are provided with adjusting screws 10 for individual adjustment of the anodes relative to frame 11. Lifting gear 12 is driven by an electric geared motor 13 above the horizontal shaft whereby supporting frame 11 for anodes 8 can be raised and lowered on supports 14 by a bevel gear drive as indicated by the arrows.

The illustrated lifting device is preferred but other actuating drives can also be used with it being essential only that coarse adjustment of the anodes is made jointly while the fine adjustment of the anodes can be made individually by manual means. The connecting lines and the fastening elements for the feed lines to the anodes are preferably made of the same material as the bus bars. Also, temperature equalizing means may be provided to equalize temperature differences in the various bus bars. The measuring unit may also be designed as a single device so that a cell without any motor adjustment can be manually adjusted.

Various modifications of the apparatus and method of the invention may be made without departing from the spirit or scope thereof and it is to be understood that the invention is intended to be limited only as defined in the appended claims.

What I claim is:

1. A monitoring and control apparatus for a single flowing mercury electrolytic cell by measurements of the voltage drop in the shunted feed line of each metal anode group comprising taps at the ends of a measured section of electrical bus bars for each metal anode group electrically connected to a measuring means whereby the measured voltage drop is fed as an amplified signal to the measuring means, a control means set for a value from the total cell current divided by the number of taps comparing the actual measured values at various feed lines and a signal means activated when a set excess current is exceeded and to actuate the adjusters for a group of metal anodes to lift the metal anodes stepwise by an adjustable amount until excess current is not measured by comparison indicating that the feed line is no longer overloaded.

2. An apparatus of claim 1 wherein the actuators for metal anode groups are driven stepwise after comparison with the average value until excess current is not measured anymore.

3. An apparatus of claim 1 or 2 wherein the nominal and actual values are digitally displayed.

4. An apparatus of claim 1 or 2 wherein the feed line with excess current range is indicated after correction of the cause until the cell is adjusted to the proper voltage.

* * * * *